US008322111B2

(12) United States Patent
Near et al.

(10) Patent No.: US 8,322,111 B2
(45) Date of Patent: Dec. 4, 2012

(54) METHOD OF INSULATING OVERHEAD CAVITIES USING SPRAY-APPLIED FIBROUS INSULATION AND THE INSULATION MATERIAL RESULTING FROM THE SAME

(75) Inventors: Daniel Elden Near, Littleton, CO (US); Ralph Michael Fay, Lakewood, CO (US)

(73) Assignee: Johns Manville, Denver, CO (US)

( * ) Notice: Subject to any disclaimer, the term of this patent is extended or adjusted under 35 U.S.C. 154(b) by 1147 days.

(21) Appl. No.: 11/731,066

(22) Filed: Mar. 30, 2007

(65) Prior Publication Data

US 2007/0234649 A1 Oct. 11, 2007

Related U.S. Application Data

(60) Provisional application No. 60/744,099, filed on Mar. 31, 2006.

(51) Int. Cl.
*E04B 1/00* (2006.01)

(52) U.S. Cl. ..... 52/741.4; 52/742.13

(58) Field of Classification Search ..... 52/73, 742.13, 52/404.1, 741.4; 427/206, 207.1, 208.4; 156/71

See application file for complete search history.

(56) References Cited

U.S. PATENT DOCUMENTS 2,732,258 A * 1/1956 Fisher ..... 239/416.5
3,085,834 A * 4/1963 Woten et al. ..... 406/53
4,075,807 A * 2/1978 Alderman ..... 52/407.4
4,134,242 A 1/1979 Musz et al.
4,272,935 A 6/1981 Lukas et al.
4,411,390 A * 10/1983 Woten ..... 241/98
4,465,239 A * 8/1984 Woten ..... 241/98
4,673,594 A 6/1987 Smith
4,710,309 A 12/1987 Miller
4,710,480 A 12/1987 Buschmann et al.
4,712,347 A * 12/1987 Sperber ..... 52/404.1
4,768,710 A * 9/1988 Sperber ..... 239/8
4,773,960 A 9/1988 Vincelli et al.
4,804,695 A 2/1989 Horton
4,923,121 A * 5/1990 Boyer ..... 239/434.5
5,106,447 A * 4/1992 Di Rado et al. ..... 156/334
5,131,590 A * 7/1992 Sperber ..... 239/8
5,389,167 A * 2/1995 Sperber ..... 156/71
5,478,014 A * 12/1995 Hynds ..... 239/135
5,536,353 A * 7/1996 Fonseca ..... 156/257
5,582,644 A * 12/1996 Gaddis et al. ..... 118/303
5,641,368 A 6/1997 Romes et al.
5,666,780 A 9/1997 Romes et al.
5,916,393 A * 6/1999 Shaffer et al. ..... 156/82
5,921,055 A * 7/1999 Romes et al. ..... 52/742.13
5,947,646 A * 9/1999 Lytle ..... 406/48
5,952,418 A 9/1999 Romes et al.
6,012,263 A 1/2000 Church et al.
6,045,298 A * 4/2000 Lytle ..... 406/48
6,047,518 A * 4/2000 Lytle ..... 52/742.13

(Continued)

OTHER PUBLICATIONS

Monoglass Spray-On Insulation, Spray Applied Glass Fiber Insulation, Oct. 2002. Sandy Bay Industrial Inc., Sprayo Spray-Applied Thermal Insulation Brochure, Date Unknown.

(Continued)

*Primary Examiner* — Basil Katcheves
(74) *Attorney, Agent, or Firm* — Robert D. Touslee

(57) ABSTRACT

A method of applying thermal and acoustical insulation by spraying an air entrained stream of high velocity pils onto an overhead surface in concert with a liquid-based adhesive is disclosed.

20 Claims, 8 Drawing Sheets

U.S. PATENT DOCUMENTS

| | | | | |
|---|---|---|---|---|
| 6,088,968 | A * | 7/2000 | Williston et al. | 52/64 |
| 6,262,164 | B1 | 7/2001 | Church et al. | |
| 6,584,749 | B2 * | 7/2003 | Sperber | 52/742.1 |
| 6,662,516 | B2 * | 12/2003 | Vandehey et al. | 52/407.1 |
| 6,820,819 | B2 * | 11/2004 | Sperber | 239/8 |
| 7,341,631 | B2 * | 3/2008 | Fellinger | 118/308 |
| 2005/0284338 | A1 * | 12/2005 | Dwyer et al. | 106/711 |
| 2006/0162649 | A1 | 7/2006 | Fellinger | |
| 2006/0163763 | A1 * | 7/2006 | Fellinger | 264/35 |
| 2006/0165885 | A1 * | 7/2006 | Fay | 427/206 |
| 2007/0140672 | A1 | 6/2007 | Fellinger | |

OTHER PUBLICATIONS

Sandy Bay Industrial Inc., Thermal & Acoustical Systems Brochure, Date Unknown.

Guardian Fiberglass Inc., AsureR Dimensionally Stable Fiberglass Spray-On Insulation, Feb. 2002.

Guardian Fiberglass Inc., GuaranteedR Stablized Fiberglass Attic Insulation, 2001.

Shawn Adams, Identification and Treatment of Toxic Molds, Occupational Health & Safety, 2002, pp. 38, 40, 42.

* cited by examiner

METHOD OF INSULATING OVERHEAD CAVITIES USING SPRAY-APPLIED FIBROUS INSULATION AND THE INSULATION MATERIAL RESULTING FROM THE SAME

CROSS-REFERENCE TO RELATED APPLICATION

This application claims the benefit of U.S. Provisional Application No. 60/744,099, filed Mar. 31, 2006, incorporated herein by reference in its entirety.

FIELD

The present disclosure is directed to a method of insulating overhead surfaces in a structure by applying a sprayed-allied fibrous insulation.

BACKGROUND

It is conventional to pump or blow loose fill fibrous insulation into attics, walls, etc. of houses and other buildings. It is also known to add a binder, de-dusting oil, anti-static agent and/or fungicide to small pieces of fiberglass, mineral wool or other fibrous insulation in or near a blowing nozzle to prevent settling, sparking and mold, or to reduce dust during installation. Such technology can be found in U.S. Pat. Nos. 4,710,309 and 4,804,695, but as stated in U.S. Pat. No. 5,952,418, these systems suffer from problems of blockage of adhesive nozzles and/or blowing hose. Further, these systems cause the resulting insulation to have a moisture content in the pre-installed product that it is ill-suited for overhead application.

While it is known to spray loose fill cellulose insulation into a wall cavity, to make the insulation remain in the cavity and not fall out, it is necessary to penetrate it with significant water. As much as 2-3 pounds or more of water exists in such insulation as installed in a standard wall cavity formed by the construction of 8 foot, 2×4 inch studs, 16 inch on-center. Such installation takes days to dry sufficiently to allow installation of wallboard. It is also known to add a powdered adhesive to the cellulose insulation to reduce the water needed to allow the cellulose to stick to the wall of the cavity as disclosed in U.S. Pat. No. 4,773,960, but the just-installed insulation contains more than 15 weight percent water based on the dry weight of the installed material.

It is also known to spray clumps of fiber glass insulation, coated with water and a non-foaming binder, into wall cavities followed by rolling at least about an inch of excess insulation thickness down to the thickness of the wall studs, followed by spraying additional clumps of insulation into any thin spots or unfilled cavities and apparently again rolling excess thickness down to the thickness of the studs.

While U.S. application Ser. No. 11/043,747, incorporated herein by reference, discloses generally a method for insulating cavities in a building structure, none of the known methods referenced above are known to be used on overhead surfaces without further modification. In most cases, the mass attributable to water used in the known processes limits the ability of the spray-applied insulation systems to be used effectively in overhead applications. Accordingly, there is a need to provide loose fill insulation, particularly an inorganic fiber insulation, that contains a low, or substantially no moisture content just after installation for insulating overhead surfaces such as ceiling cavities. Additionally, there is a need to provide a loose fill insulation that contains a low, or substantially no moisture content just after installation for insulating overhead surfaces such as ceiling surfaces that will dry more rapidly to a level suitable for gypsum board installation, thereby reducing cost of construction and reducing the potential for mold problems, and which is capable of adhering to overhead surfaces including, but not limited to: OSB, metal decking, corrugated metal panels, natural lumber, open- and closed-cell foam products, and concrete. The present disclosure addresses these needs, and provides a method to produce a superior just-installed insulation product for overhead surfaces.

SUMMARY

Presently disclosed is a method for receiving a stream of air entrained, fully dry or substantially dry fibrous clumps, nodules, pils and mixtures thereof, the pils making up only a small weight percent of the fibrous material, of an inorganic fibrous material from a conventional insulation blowing machine, passing the stream through a shredder to convert much of the clumps, nodules or mixtures thereof to pils, and then substantially increasing the velocity of the air entrained pils prior to spraying the pils onto an overhead surface. The present method for installing building insulation onto an overhead surface comprises: applying a priming layer of adhesive to a surface of a structure; directing clumps, nodules, or mixtures thereof of mineral fiber insulation suspended in air onto an overhead surface causing most of the fiber insulation to adhere to one or more surfaces, or to each other, or the priming layer to form a base layer of insulation; and directing the mineral fiber insulation suspended in air onto the surface causing most of the fiber insulation to adhere to the surface, or to each other, or the base layer to form a fill layer of insulation.

The foregoing has broadly outlined the features and technical advantages of the present invention in order that the detailed description of the invention that follows may be better understood. Additional features and advantages of the methods and compositions disclosed herein will be described hereinafter which form the subject of the claims. It should be appreciated that the conception and specific embodiments disclosed may be readily utilized as a basis for modifying or designing other structures for carrying out the same purposes of the methods and compositions disclosed herein. It should also be realized that such equivalent constructions do not depart from the methods and compositions disclosed herein. The novel features which are believed to be characteristic of the methods and compositions disclosed herein, both as to its organization and method of operation, together with further objects and advantages will be better understood from the following description.

In addition to the exemplary aspects and embodiments described above, further aspects and embodiments will become apparent by reference to the figures and by study of the following descriptions.

BRIEF DESCRIPTION OF THE DRAWINGS

Exemplary embodiments are illustrated in the referenced figures of the drawings. It is intended that the embodiments and figures disclosed herein are to be considered illustrative rather than limiting.

DETAILED DESCRIPTION

Blowing clumps of fibrous insulation using a blowing machine and spraying an aqueous binder mixture onto the clumps in a hose or nozzle while in air suspension, and thereafter directing the air suspension into a wall cavity to form in-wall thermal insulation between vertical studs is known, but problems have been encountered in getting the insulation to remain in the wall cavities if the moisture content of the air entrained insulation is at a low level, particularly with just-installed moisture content below about 10 wt. percent, and particularly below about 5 wt. percent. Similarly, as a result of the high weight percent of water in typical spray-applied wall insulation systems, it was previously not known to use spray applied insulation systems to insulate overhead surfaces to a completely filled state.

Figure 5:
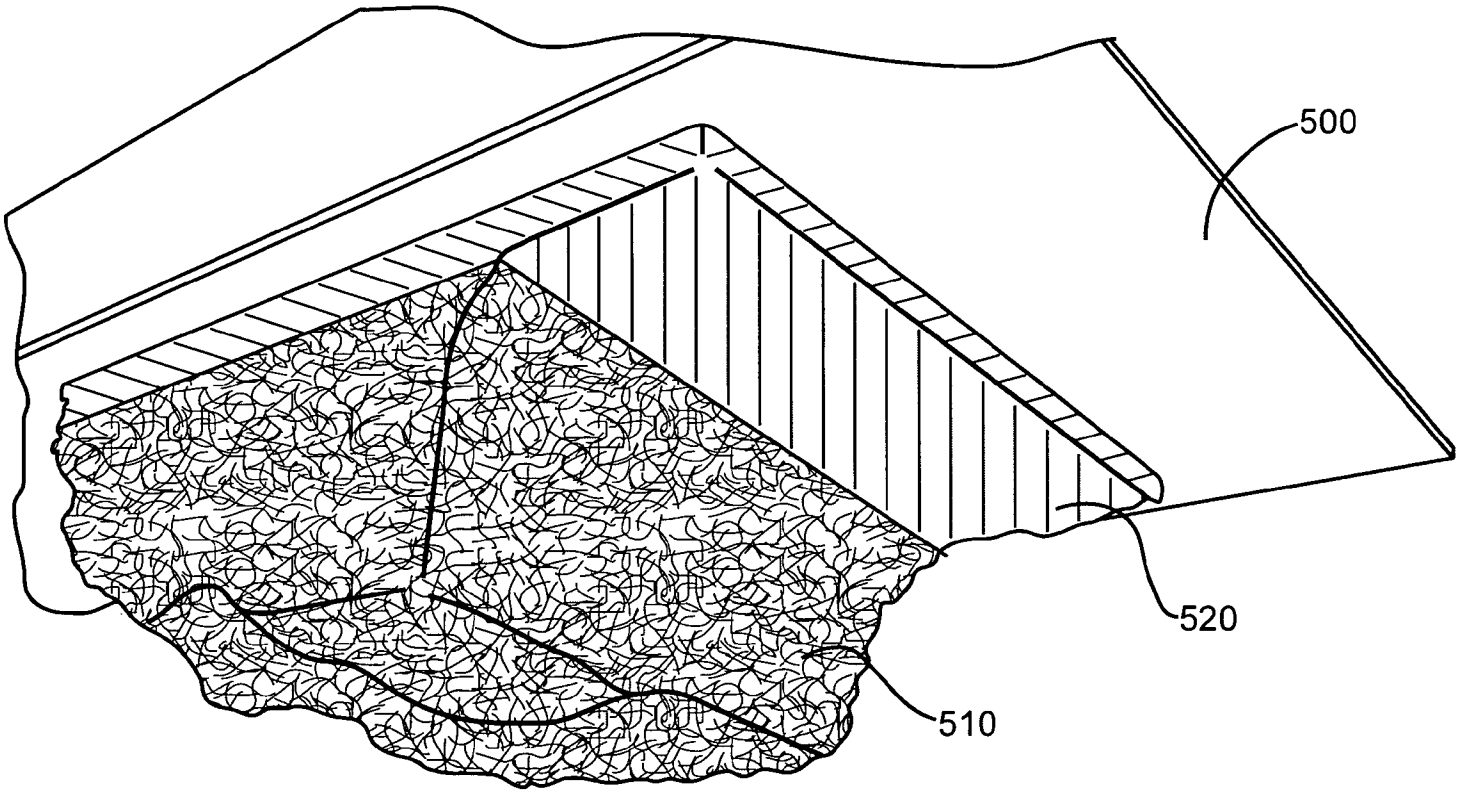
FIG. 5 is a perspective view of OSB overhead surface 500 upon which insulation material 510 is applied to a layer of closed-cell foam insulation material 520 by the presently described method.
Figure 6:
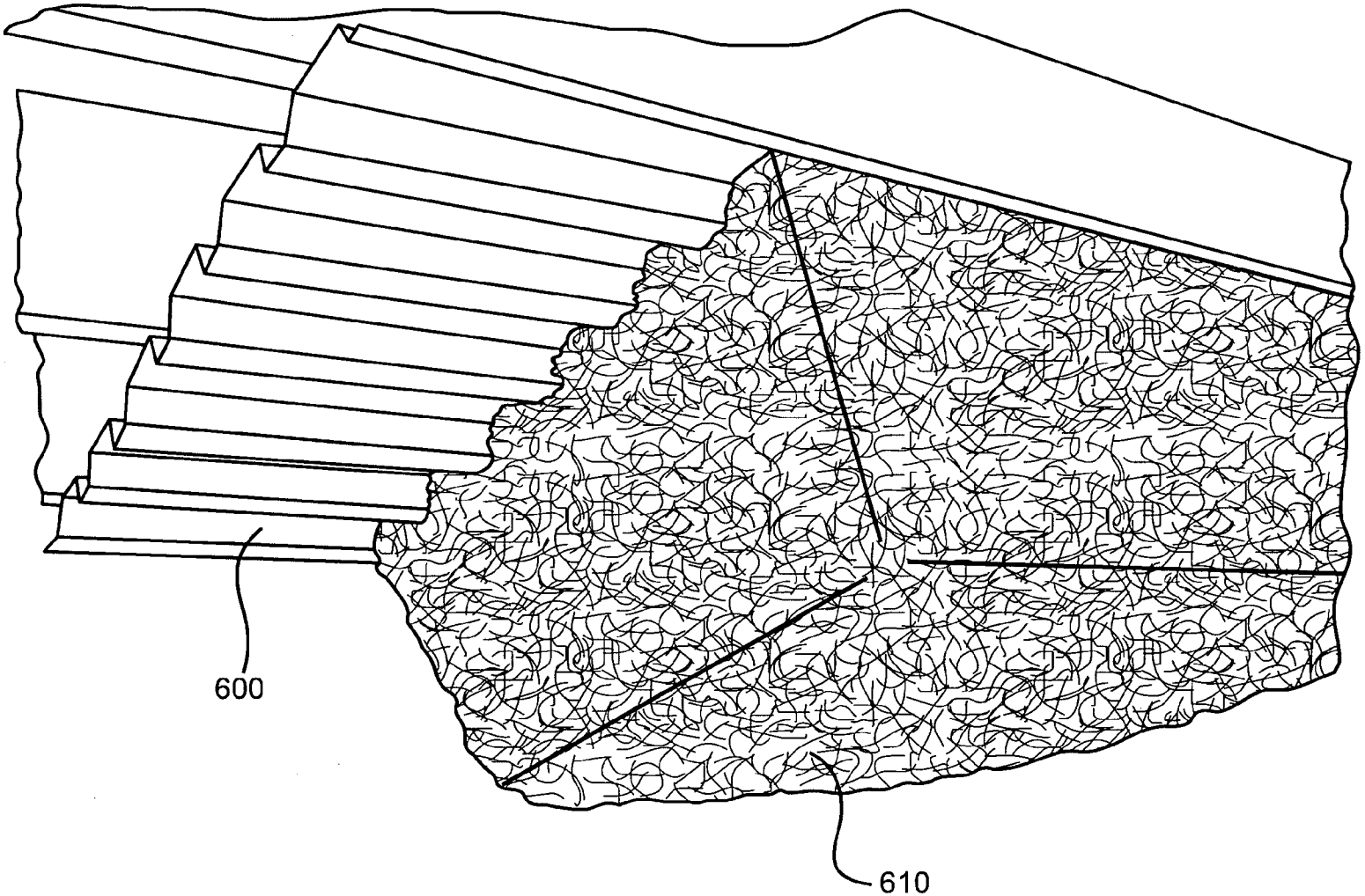
FIG. 6 is a perspective view of corrugated metal panel overhead surface 600 upon which insulation material 610 is applied by the presently described method.
Figure 7:
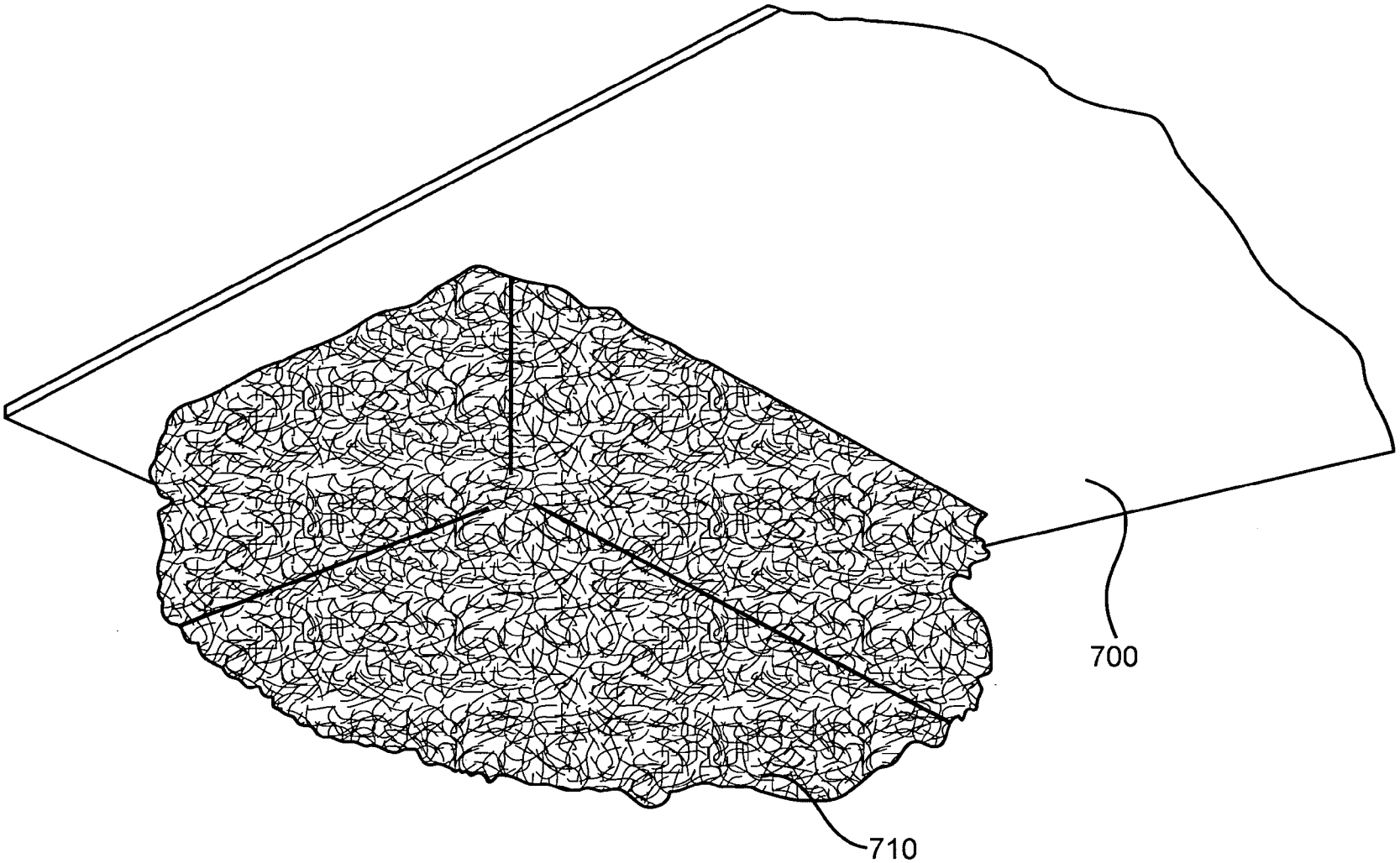
FIG. 7 is a perspective view of pre-fabricated concrete board overhead surface 700 upon which insulation material 710 is applied by the presently described method.

The terms "overhead cavity" and "ceiling cavity" as used herein mean a space defined by one or more overhead surfaces, typically comprised of one or more framing members and/or a decking substrate. The term "overhead surface" as used herein means a building substrate, typically comprised of a framing member or deck surface. Typical cavities are shown in FIGS. 1-4, and some typical decking substrates are shown in FIGS. 5-7. In standard building practices a framing member is typically timber-based dimensional lumber, ranging from 2"×4" to 2"×20" boards of varying length. Framing members include, but are not limited to: natural lumbar, engineered wood, metal, and composite building products of various dimensions. Decking substrates include, but are not limited to: oriented strand board ("OSB"), plywood, hardboard, metal decking, corrugated metal panels, natural lumber, poured concrete, or prefabricated concrete. As used herein, a decking substrate may also include spray-applied or rigid open- or closed-cell foam insulation, foam or fiberboard vent chutes, plastic vent chutes, and other products known in the construction art, and any combination thereof, which are installed in buildings prior to the installation of insulation materials.

It is known how to make loose-fill clumps, 0.5 inch diameter, of inorganic, mineral fibers for forming blown-in insulation by passing virgin fiber or scrap resin bonded fiber product through a perforated plate in a hammer mill. The inorganic and/or mineral fibers used in the present disclosure may be glass, mineral wool, slag wool, or a ceramic fiber, and is preferably fiber glass. The loose fill clumps and/or nodules of fibrous insulation for use in the present disclosure are made by running virgin fiber or fiber product scrap through a conventional hammer mill, a slicing/dicing apparatus, or an equivalent material processing machine. A slicing/dicing apparatus cuts or shears blankets of fibrous insulation into small cube like or other three dimensional pieces, while hammer mills and like machines tear and shear virgin fiber glass or fiber glass blanket into pieces, collecting only pieces below a pre-selected size through use of an exit screen containing the desired hole size. Virgin fiber is a fiber web or blanket made specifically for spray insulation and typically contains no resin binder.

Any type of fibrous insulation product can be processed in a hammer mill, e.g., fibrous blanket in which fibers, including glass fibers, are bonded together with a cured, usually thermoset resin, or a blanket of virgin fiberglass containing only de-dusting oil, silicone, anti-stat, etc. Also, the binder used to bond glass fibers together in the blanket may also contain one or more functional ingredients such as infrared barrier agents, anti-static agents, anti-fungal agents, biocides, de-dusting agents, pigments, colorants, etc., which may be applied to the fibers either before, or during processing in the hammer mill or other reducing device. The size of hammer mill exit screen openings are varied to produce the desired size of clumps and/or nodules. The typical size of exit screen openings range from about one inch to about three inches, and a more typical size hole is about 1.25 inches.

The clumps and/or nodules of mineral fiber such as fiberglass can also derive from what is called "virgin blowing wool." This is achieved by making insulation fiber in a conventional manner except that no resin or binder is applied to the fibers. Instead, only a conventional amount of de-dusting oil and/or an anti-stat like silicone is applied to the fibers and the resultant fibrous blanket is then run through the hammer mill. Other agents can also be applied to the fibers such as a fungicide, a biocide, filler particles and/or infrared reflecting particles.

The spray-applied insulation exiting a nozzle in the present method can contain no significant moisture (water) except for what may have been absorbed from the environment, but the just-installed insulation product may have a moisture content of up to about 5 wt. percent based on the dry weight of the installed product. When the term "just-installed" is used herein, it is meant a sprayed-in insulation product no more than 10 minutes after installation. The air suspended stream of fibrous insulation exiting the shredder section of the delivery system or nozzle assembly contains at least 50 wt. percent pils. This increased pils content is important to the sticking power of the pieces of fibrous insulation as it is consolidated on a building surface. By "fully dry" is meant that the insulation contains only that amount of moisture absorbed from a humid environment and is normally below about 2 wt. percent, and is usually less than 1 wt. percent. By "substantially dry" is meant a moisture content of less than about 5 wt. percent.

Inorganic fibers are usually fiber glass, but other fibers may be used such as slag wool, mineral wool, rock wool, cellulosic fibers, ceramic fibers, and carbon fibers. Ideally, the average diameter of the fiber is about 2 microns or less. The average inorganic and/or mineral fiber diameter can be 6 microns or smaller, but typically is less than about 3 microns or smaller, more typically about 2 microns or smaller, and most typically 1.5 microns or smaller. Nodules are defined as very small diameter, fibrous insulation of 0.25 inch diameter and smaller. Clumps are defined as having diameters greater than the diameter of nodules, and up to the conventional size of clumps in the blowing insulation industry, typically less than about 0.5 inch in diameter. The clumps or nodules are mostly smaller than 0.5 inch in diameter, but larger sizes can be used. The clumps and/or nodules are produced by running mineral fiber insulation such as virgin fiber glass insulation or fiber glass insulation containing a cured binder through a hammer mill, slicing/dicing machine, or other device for reducing material to small clumps and/or nodules as is common in the industry.

The shredder section of the blowing machine reduces the sizes of the clumps and nodules to pils (piliform) size, i.e., to pieces whose bodies are about 0.2 inch and smaller with a majority of pils having a diameter of less than about 0.15 inch, and more typically a majority of the pils having a diameter of less than about 0.13 inch or smaller. As used herein, the diameter of the pils is meant the diameter of the "body" of the pils, not the diameter to the ends of projecting fibers extending from the "body" of the pils. The projecting fibers on the pils entangle with pils of the just-installed insulation upon impact due to the velocity of the pils stream to provide surprisingly good just-installed integrity and strength. The shredder section can be a part of the nozzle, or, may be located upstream or downstream of the nozzle, so long as the distance traveled by the pils post-shredding does not result in pils reattachment to each other in significant frequency.

The clumps or nodules of inorganic fibrous insulation can also contain conventional amounts of one or more biocides, anti-static agents, de-dusting oils, hydrophobic agents such as a silicone, fire retardants, phase change material, particulate aerogel, coloring agents and infrared blocking agents. The other additives, when present, are also preferably included with the clumps or nodules.

When the word "about" is used herein, it is meant that the amount or condition it modifies can vary somewhat beyond that stated or claimed so long as the advantages of the invention are realized without any unexpected differences. Practically, there is rarely the time or resources available to very precisely determine the limits of every parameter in that it would require an effort far greater than can be justified at the time the invention is being developed to a commercial reality.

To produce the dry feed for the nozzles of the invention, the above described clumps and nodules are fed into a conventional insulation blowing machine which entrains the clumps and nodules in a rapidly moving air stream that exits the blowing machine via a flexible blowing hose. A typical blowing machine is a Unisul VOLU-MATIC® machine made by Unisul Company of Winter Haven, Fla. In general, a blow hose conveys the air entrained clumps and nodules to a nozzle system, having an entrance end attached to one end of the blow hose in a conventional manner.

Figure 8:
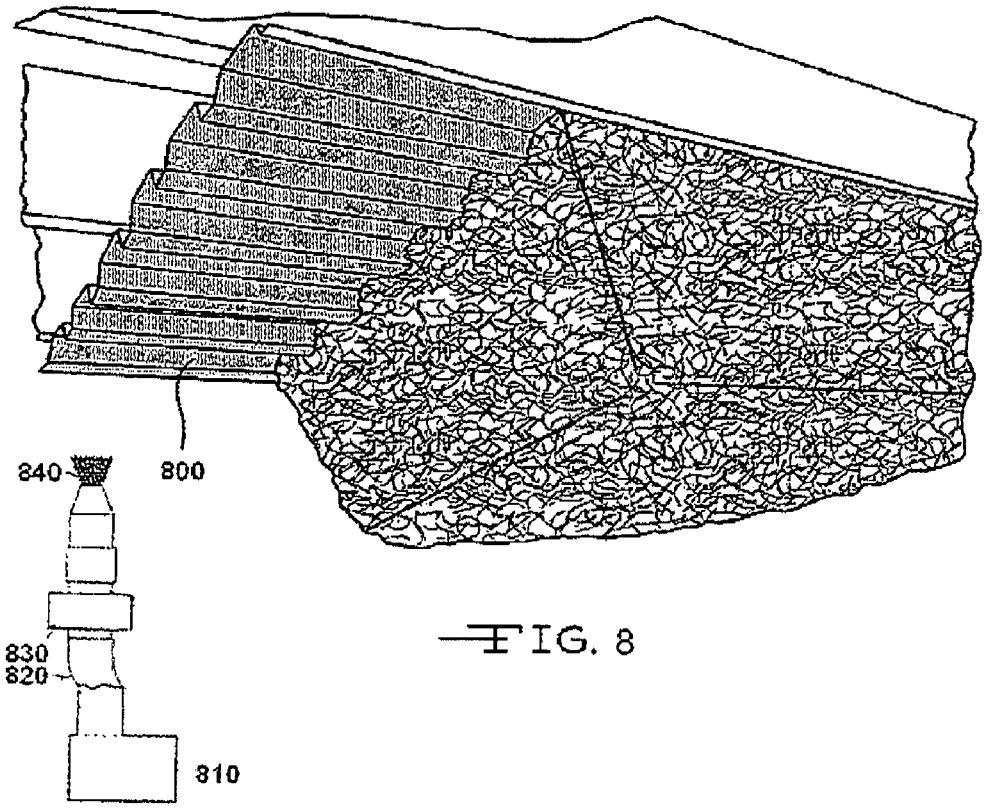
FIG. 8 is a perspective view, not drawn to scale, of an overhead surface coated with a priming layer of adhesive 800 upon which insulation material is applied by the presently described method.

FIG. 8 is a perspective view, not drawn to scale, of an overhead surface coated with a priming layer of adhesive 800 upon which insulation material is applied by the presently described method wherein clumps, nodules or mixtures thereof of mineral fiber insulation are fed into a blowing machine 810 whereby the mineral fiber insulation is suspended in an air stream and blown through a hose 820 connected to the blowing machine 810; the air suspended clumps, nodules, or mixtures thereof are passed through a shredder 830 to produce a stream of air suspended insulation pils 840; a priming layer of adhesive 800 is applied to the overhead surface; the stream of air suspended pils 840 is directed onto the overhead surface causing most of the pils to stick to the surface, or to each other to form a base layer of the mineral fiber insulation; and the stream of air suspended pils 840 is directed onto the overhead surface causing most of the pils to stick to the surface, or to each other to form a fill layer of the mineral fiber insulation.

To install thermal insulation using an aqueous adhesive, it is preferred that the aqueous adhesive is supplied by the manufacturer at the proper concentration without further mixing or dilution. In other cases, aqueous adhesive may be made up by adding the proper amount of water to a tank, and then adding the proper amount of a resin, preferably a concentrated solution of the resin, to the water in the tank while optionally stirring to insure proper mixing. If a powdered resin is used, more time and stirring will be required to obtain a relatively homogenous solution. Also, particularly when the water in the tank is cool, it may be advantageous to heat the water to at least room temperature before adding the resin, or using a heated adhesive cart, as described in U.S. application Ser. No. 11/314,435, incorporated herein by reference. Numerous water-soluble resins can be used in the present method, but the preferred resin is a polyester resin, preferably a hydrolyzed polyester resin in concentrated solution in water, such as a concentration of about 10-30 percent. The most typical resin for use in the present invention is a water-soluble, partially hydrolyzed polyester oligomer such as SA-3915 available from Henkel Corporation of Greenville, S.C. This resin is preferably used at a concentration of about 10-30 percent and most typically at about 15 percent. Another resin option is a polyvinyl alcohol resin available from Para-Chem Corporation, Simpsonville, S.C.

An adjustable-rate pump connected to the adhesive tank supplies the aqueous adhesive at the desired rate and pressure to spray jet(s) through one or more flexible hoses to properly coat the pils with the desired amount of aqueous adhesive. Many different types of spray jets can be used, and one that performs well is Spray Systems Co. 65 degree flat spray nozzle with an orifice size ranging from 0067 to 0017 in capacity size.

The resultant just-installed aqueous adhesive coated mineral fiber insulation has a moisture content of less than about 5 wt. percent, based on the dry weight of the material, more typically less than about 4 wt. percent, and most typically less than about 3 wt. percent. In one embodiment, a layer of adhesive, also referred to as an adhesive post-coat, is applied to the fill layer of just-installed insulation. The adhesive post-coat layer provides additional structural integrity to the just-installed insulation.

The nozzle system used in the presently described method permit spraying dry or substantially dry fibrous insulation onto surfaces to form just-installed insulation having good integrity without having to use conventional restraining means, e.g., netting, to secure the just-installed insulation on the surface prior to applying gypsum board or other facing products. The minimum moisture content of the installation method reduces the required drying time before gypsum board installation. In addition, using the presently described method permits installation of the insulation onto surface structures such as, but not limited to: cathedral ceilings, horizontal ceilings, sub-floors, and truss structures, and applied on multiple surfaces such as, but not limited to: OSB, plywood, hardboard, natural lumber, metal decking, corrugated metal panels, foam insulation, foam or fiberboard vent chutes, and poured or prefabricated concrete, or any combination thereof. Furthermore, once fibrous installation is complete gypsum board or other facing material may be installed immediately, or immediately following an optional conventional step of dressing the just-installed insulation to remove excess thickness, or immediately following application of a post-coat adhesive layer.

EXAMPLE 1

The present method was used in a cathedral ceiling and flat roof construction to provide thermal insulation from the outside environment, and was used in interior floors for sound control. Overhead installation was completed on multiple surfaces, including OSB, plywood, hardboard, natural lumber, foam insulation, and foam or fiberboard vent chutes.

Appropriate personal protective equipment was worn by an installer, including a NIOSH N95 compliant dust mask, safety glasses, gloves, and long sleeved, loose fitting clothing. Hooded garments are recommended as well in that the installer is positioned under the insulation material as it is installed.

Areas not designated to be filled with the insulation material (e.g., canned lights or sky lights) were masked off with tape or a poly-sheet material. Penetrations through floors should be sealed with expanding foam or caulk for air sealing and to ensure good acoustic performance. Penetrations in fire rated assemblies may need to be sealed with fire-rated caulk. There may be also be transition areas between the insulated wall and overhead areas that need to be insulated, but lack a backing surface to spray against. These areas will need to be netted as done for open walls.

Figure 1:
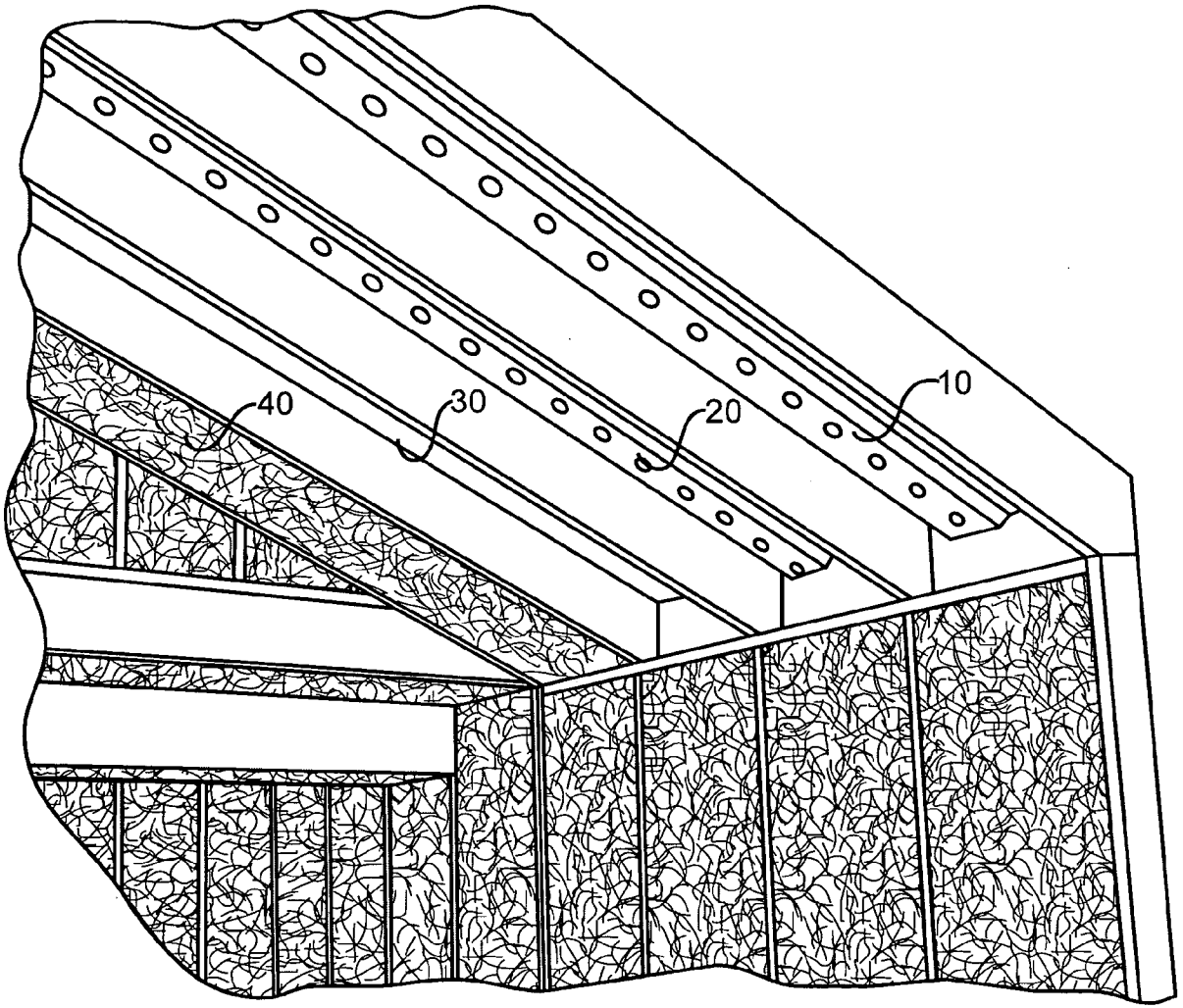
FIG. 1 is a perspective view of a series of cathedral ceiling cavities. Cavity 10, cavity 20, and cavity 30 are shown as un-insulated. Cavity 40, as shown, has been insulated by the presently described methods.
Figure 2:
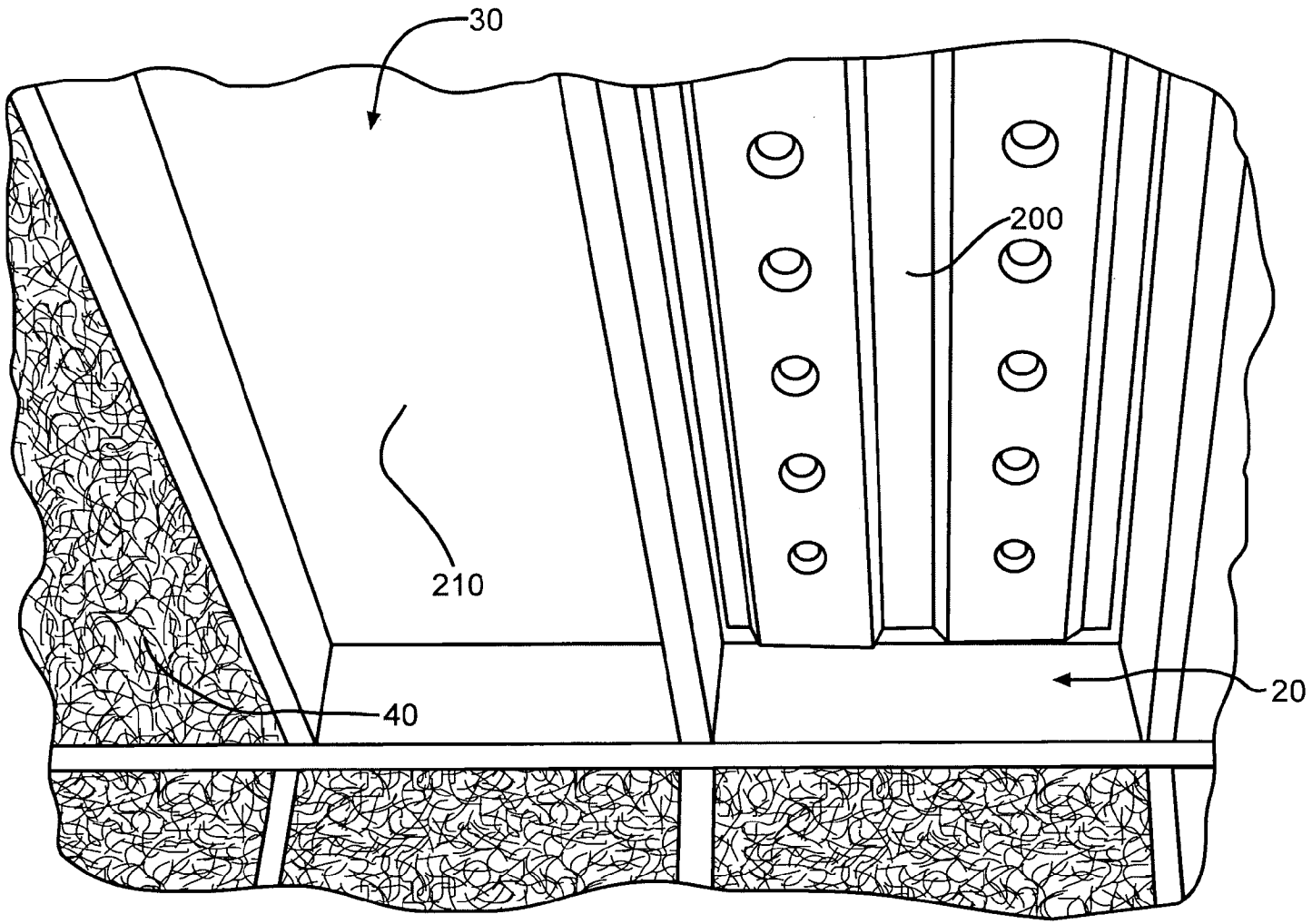
FIG. 2 is a perspective view of the series of cathedral ceiling cavities of FIG. 1 showing various ceiling deck substrates upon which the insulation material is applied. Un-insulated cavity 20 is shown with a vent chute 200, and un-insulated cavity 30 is shown with an OSB roof deck 210. Cavity 40, as shown, has been insulated by the presently described methods.
Figure 3:
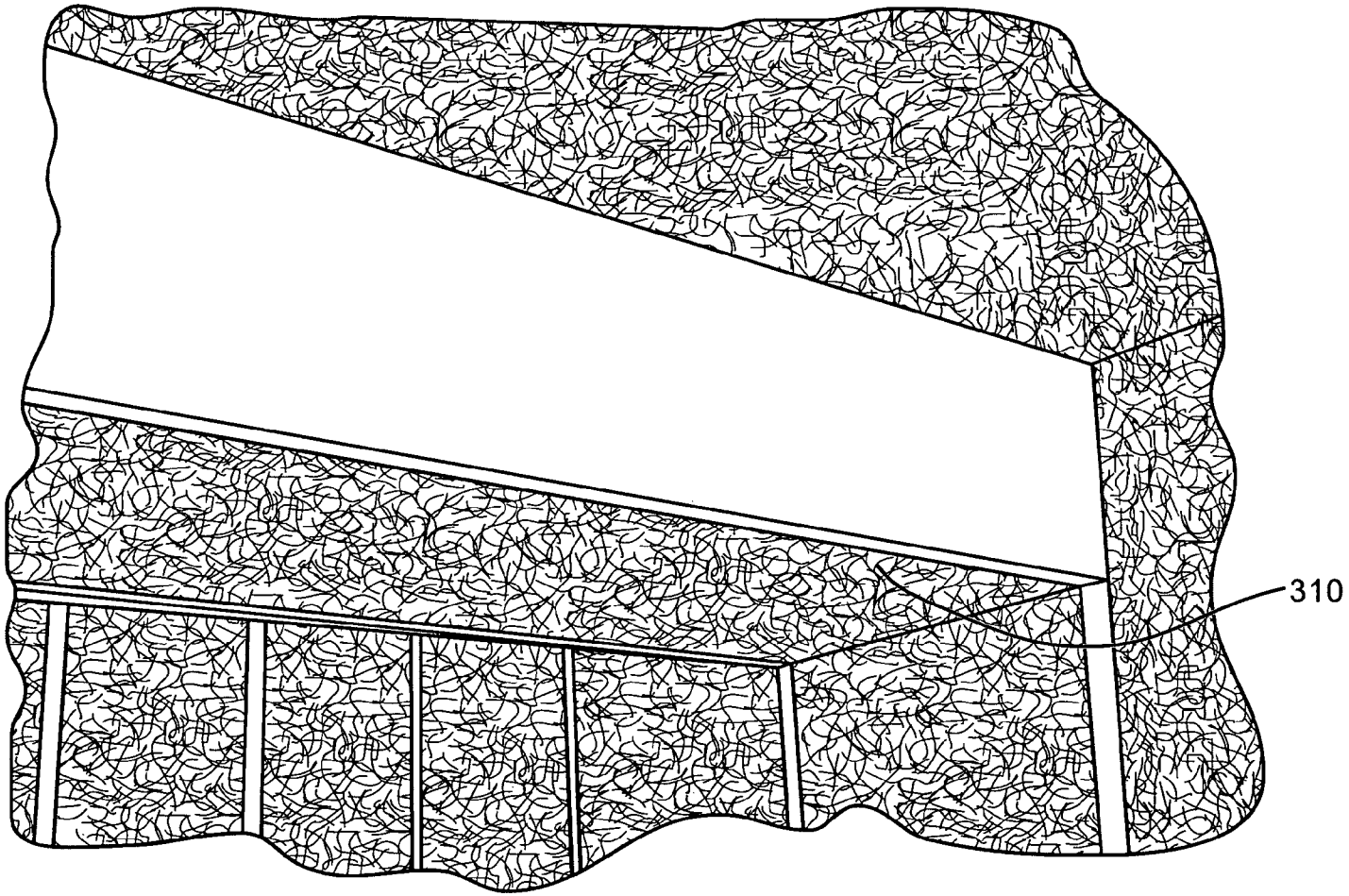
FIG. 3 is a perspective view of a horizontal ceiling cavity filled with insulation material 310 by the presently described method.
Figure 4:
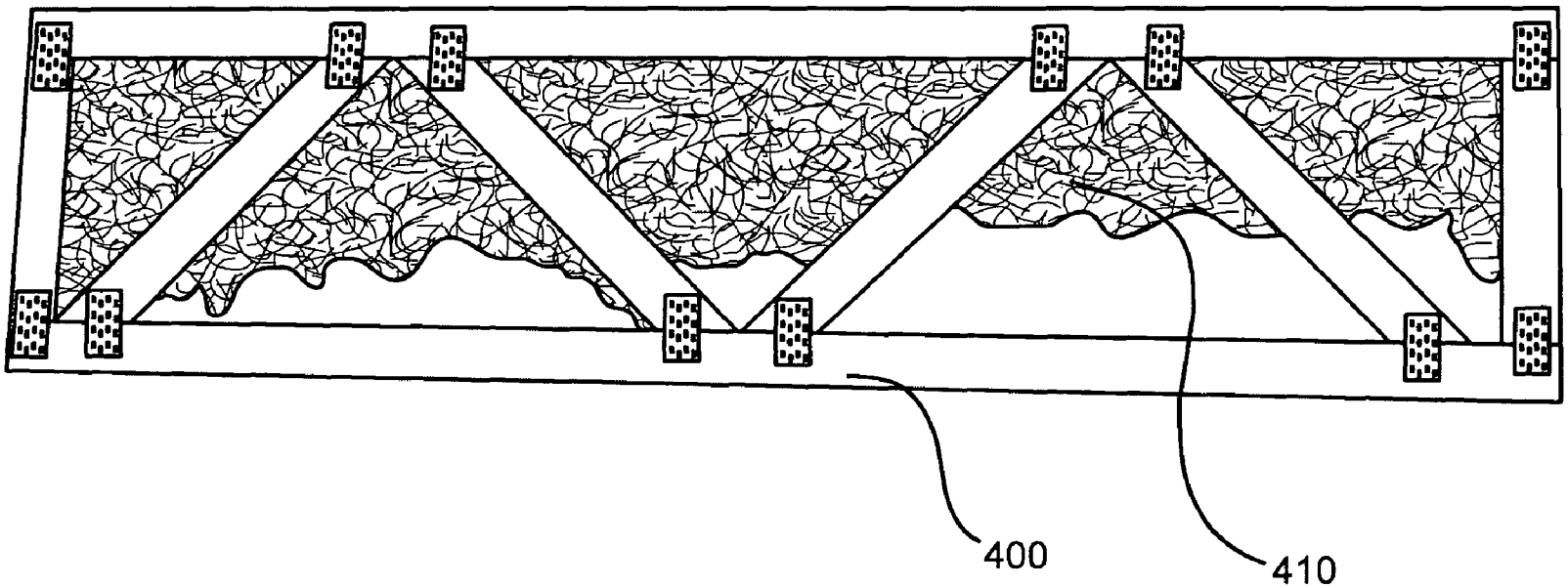
FIG. 4 is a perspective view of a horizontal truss structure 400 with insulation material 410 applied by the presently described method.

Vent chutes are sometimes required in cathedral ceilings to provide a ventilation channel. In addition to standard ceiling cavities, the presently described insulation installation method was also used to install against securely stapled vent chutes as shown in FIGS. 1 and 2.

Site preparation included a sweep of the floor to ensure that recycled content resulting from excess material not adhered to the ceiling cavity during installation and excess material scrubbed off the cavity opening was free of contaminants.

Equipment settings used for overhead installation were as follows:

Blowing machine transmission in 3$^{rd}$ gear;

Blowing machine air flow set at maximum (100% of blower air delivered to airlock);

Blowing machine slide gate set at ¾ open (to achieve ~20 lb/min mass flow rate of insulation material);

Blowing machine set at manufacturer's recommended RPM.

Under standard conditions and settings, a 30 lb. bag of loose-fill fiber glass insulation (SPIDER blowing wool, Johns Manville, Denver, Colo.) was installed in about 1 to 2 minutes at a rate of about 15 to 30 lbs. per minute.

For application of adhesive, two 650025 spray tips (Johns Manville, Denver, Colo.) were used. Under cold conditions, larger orifice tips may be used. With the 650025 tips, the spray apparatus (Johns Manville, Denver, Colo.) was set to achieve 900 to 1200 psi during spraying. Pressure during installation at the exit end of the nozzle was between about 2.8-3.0 psi. Adhesive spray rate was in the range of 1.5 to 2.1 lbs. per minute, which is about 0.25 to 0.50 gallons per 30 lb. bag of loose-fill fiber glass insulation. While a ratio of insulation to adhesive of 20 parts insulation, to 1 part adhesive is favorable, preferably the lowest adhesive rate that achieves adequate insulation adhesion and integrity should be used to reduce the amount of added moisture to the building cavity and to reduce the cost of adhesive.

Following OSHA regulations for work on ladders and scaffolds, overhead installations required the installer to work on a scaffold or ladder to ensure that the proximity of the nozzle tip was close enough to the overhead sub-floor or deck.

Preferably, the installer used a haul line or other method to safely lift the nozzle and hose up to the working level. It was also useful to tether or anchor the nozzle end of the hose to the ladder or scaffold. The tether should be long enough to allow the installer to maneuver the nozzle in the required work area, but short enough to prevent the nozzle from falling onto workers below or being damaged by impact to the floor.

An adhesive prime coat was first applied to the sub-floor or deck surface using the spray nozzle assembly with no insulation flowing. The nozzle was held about 2 feet from the surface and was oriented so that the spray fan pattern paints a wide uniform strip of adhesive as the nozzle passes under the working surface. Only the surface of the sub-floor or deck was sprayed. An adhesive prime coat was not applied to the framing members. A 24 inch wide cavity 6 feet in length required 2 or 3 passes and about 5 seconds to adequately prime the surface which is about 0.01 to 0.03 lbs./ft$^2$ of adhesive. In general, the installer should prime as large an area as can be conveniently and safely covered without moving his scaffold or ladder in that the adhesive prime coat has a long working time.

After application of the prime coat, the installer began installation of insulation material at one end of a cavity. In a cathedral ceiling, the installer started at the top or bottom end, whichever was more convenient. Holding the nozzle as nearly perpendicular as possible to the band joist surface, a base layer of insulation material was sprayed to bring the insulation surface out past the surface of the adjoining wall. When the end of the cavity was filled, the installer continued spraying out from the end with a base layer of the insulation and adhesive mixture approximately 1 inch thick, covering the cavity area to about 4 feet from the end. The density of the installed insulation material varies depending upon distance of the nozzle from the surface. Generally, the nozzle was maintained at a distance of about 2 feet from the deck surface to obtain an installed "dry" density of about 1.8-2.0 pcf.

As the installer completed the section of base layer, he doubled back and completed filling the cavity, starting from the filled end in a manner such that the insulation built up to a level about even with the bottom of the framing members. The installer filled the cavity, but left a "working edge" area of unfilled base layer about 1 foot long from which he then moved and began installing insulation material to the primed area abutting the base layer and laid down about another 3 or 4 feet cavity length of 1 inch thick base layer.

The installer continued spraying base layer, and then filled the cavity in about 3 to 4 foot increments until the end of the cavity, or the end of the primed area, was reached. In one embodiment, two or more adjacent cavities are filled between scaffold movements. Excess insulation material was mechanically removed from the exposed cavity surface with a scrubbing device. Excess insulation material that fell to the floor was removed and reused by adding it back to the blowing machine.

EXAMPLE 2

The present method was used in a cathedral ceiling and flat roof construction to provide thermal insulation from the outside environment, and was used in interior floors for sound control. Overhead installation was completed on a majority of surfaces, including OSB, plywood, hardboard, natural lumber, foam insulation, and foam or fiberboard vent chutes. Furthermore, installation of the insulation material was completed in the wall cavities as well. Where the insulation material was used in both wall and overhead cavities, it is preferred to complete the overhead installation first. All other steps are as described in Example 1.

EXAMPLE 3

The present method was used in a cathedral ceiling and flat roof construction to provide thermal insulation from the outside environment, and was used in interior floors for sound control. Overhead installation can be applied to a majority of surfaces, including OSB, plywood, hardboard, natural lumber, foam insulation, and foam or fiberboard vent chutes. Furthermore, installation of the insulation material can be completed in the wall cavities as well. In addition to the steps described in Example 1, an adhesive post-coat is applied to the fill layer of insulation material.

EXAMPLE 4

The present method was used on an overhead surface of closed-cell spray-on foam insulation applied to an OSB surface. Insulation was applied directly on closed-cell spray-on foam insulation, to a depth of approximately 12 inches, and density of about 1.8-2.0 pcf. No adhesive post-coast layer was applied to the fill layer of insulation material.

EXAMPLE 5

The present method was used on an overhead surface of corrugated metal panel. Insulation was applied to the metal panel surface, to a depth of approximately 12 inches, and density of about 1.8-2.0 pcf. No adhesive post-coast layer was applied to the fill layer of insulation material.

EXAMPLE 6

The present method was used on an overhead surface of pre-fabricated concrete board. Insulation was applied to the pre-fabricated concrete board decking surface, to a depth of approximately 12 inches, and density of about 1.8-2.0 pcf. No adhesive post-coast layer was applied to the fill layer of insulation material.

Several examples and ranges of parameters of several embodiments of the presently described method have been disclosed above, but many other embodiments will be apparent to those of ordinary skill in the insulation field by manipulating the parameters of the following claims. While most of the above discussion involves using the present method on overhead surfaces, this insulation installation method can be used to insulate other areas and cavities having angular surfaces that can be reached with an array of air suspended products.

A skilled artisan will understand and expect that the disclosed results of the invention may extend beyond one or more of the limits disclosed. Later, having the benefit of an inventor's disclosure and understanding the inventive concept and embodiments disclosed, including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term about as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

What is claimed is:

1. A method of installing building insulation on an overhead surface, the method comprising:

a) feeding clumps, nodules, or mixtures thereof of mineral fiber insulation into a blowing machine whereby the mineral fiber insulation is suspended in an air stream and blown through a hose connected to the blowing machine;

b) passing the air suspended clumps, nodules, or mixtures thereof through a shredder to produce a stream of air suspended insulation pils;

c) applying a priming layer of an adhesive to an overhead surface;

d) directing the stream of air suspended pils onto the overhead surface causing most of the pils to stick to the surface, or to each other to form a base layer of the mineral fiber insulation;

e) directing the stream of air suspended pils onto the overhead surface causing most of the pils to stick to the surface, or to each other to form a fill layer of the mineral fiber insulation.

2. The method of claim 1 wherein the pils comprise glass fibers.

3. The method of claim 2 wherein the pils also contain one or more materials selected from the group consisting of a biocide, a fungicide, infrared blocker particles or coating, a filler, a thermal insulating phase change material, an aerogel and a coloring agent.

4. The method of claim 1 wherein the pils also contain one or more materials selected from the group consisting of a biocide, a fungicide, infrared blocker particles or coating, a filler, a thermal insulating phase change material, an aerogel and a coloring agent.

5. The method of claim 1 wherein the overhead surface is selected from the group consisting of OSB, plywood, hardboard, natural lumber, metal decking, corrugated metal panels, open- or closed-cell foam insulation, vent chute, poured concrete, and prefabricated concrete.

6. The method of claim 1 wherein the overhead surface is selected from the group consisting of a cathedral ceiling, a horizontal ceiling, a sub-floor, and a truss structure.

7. The method of claim 1 wherein the base layer is between about 0.25 and 2 inches thick.

8. The method of claim 7 wherein the base layer is about 1 inch thick.

9. The method of claim 1 with an additional step of applying an adhesive post-coat to the fill layer of mineral fiber insulation.

10. The insulation material made by the method of claim 1.

11. A method of installing building insulation in a ceiling cavity of a structure, the method comprising:

a) applying a priming layer of an adhesive to a decking surface of a ceiling cavity;

b) directing clumps, nodules, or mixtures thereof of mineral fiber insulation suspended in air into the ceiling cavity causing most of the fiber insulation to adhere to one or more surfaces of the cavity, or to each other, or the priming layer to form a base layer of insulation; and c) directing the mineral fiber insulation suspended in air into the ceiling cavity causing most of the fiber insulation to adhere to one or more surfaces of the cavity, or to each other, or the base layer to form a fill layer of insulation.

12. The method of claim 11 wherein the clumps, nodules, or mixtures thereof comprise glass fibers.

13. The method of claim 12 wherein the clumps, nodules, or mixtures thereof also contain one or more materials selected from the group consisting of a biocide, a fungicide, infrared blocker particles or coating, a filler, a thermal insulating phase change material, an aerogel and a coloring agent.

14. The method of claim 11 wherein the clumps, nodules, or mixtures thereof also contain one or more materials selected from the group consisting of a biocide, a fungicide, infrared blocker particles or coating, a filler, a thermal insulating phase change material, an aerogel and a coloring agent.

15. The method of claim 11 wherein the decking surface is selected from the group consisting of OSB, plywood, hardboard, natural lumber, metal decking, corrugated metal panels, foam insulation, vent chute, poured concrete, and prefabricated concrete.

16. The method of claim 11 wherein the overhead cavity is selected from the group consisting of a cathedral ceiling, a horizontal ceiling, a sub-floor, and a truss structure.

17. The method of claim 11 wherein the base layer is between about 0.25 and 2 inches thick.

18. The method of claim 17 wherein the base layer is about 1 inch thick.

19. The method of claim 11 with an additional step of applying an adhesive post-coat to the fill layer of mineral fiber insulation.

20. The insulation material made by the method of claim 11.

* * * * *

UNITED STATES PATENT AND TRADEMARK OFFICE

CERTIFICATE OF CORRECTION

PATENT NO. : 8,322,111 B2
APPLICATION NO. : 11/731066
DATED : December 4, 2012
INVENTOR(S) : Daniel Elden Near and Ralph Michael Fay It is certified that error appears in the above-identified patent and that said Letters Patent is hereby corrected as shown below:

In the Claims:

Column 10, line 19, “2” should read --1--.

Column 10, line 24, “1” should read --2--.

Column 10, line 61, “12” should read --11--.

Column 10, line 66, “11” should read --12--.

Signed and Sealed this
Sixteenth Day of April, 2013

Teresa Stanek Rea

Teresa Stanek Rea
*Acting Director of the United States Patent and Trademark Office*